United States Patent [19]

Alexander et al.

[11] 4,287,692

[45] Sep. 8, 1981

[54] SAFETY APPARATUS FOR A MINING MACHINE

[75] Inventors: Clifton E. Alexander, Nortonville; Thomas R. Ford, Dawson Springs, both of Ky.; William S. Smith, Collinsville, Ill.

[73] Assignee: Peabody Coal Company, St. Louis, Mo.

[21] Appl. No.: 47,717

[22] Filed: Jun. 12, 1979

[51] Int. Cl.[3] ..... E04H 12/34; F16M 13/00

[52] U.S. Cl. ..... 52/116; 248/354 R; 410/58; 198/517

[58] Field of Search ..... 52/116–120, 52/115; 248/351, 354 P, 354 R; 410/58, 59, 61, 153

[56] References Cited

U.S. PATENT DOCUMENTS

| | | | |
|---|---|---|---|
| 2,355,867 | 8/1944 | Jarvis | 410/153 |
| 2,380,069 | 7/1945 | Peterson | 52/119 |
| 2,916,238 | 12/1959 | Fahland | 410/58 |
| 3,362,116 | 1/1968 | Erickson | 52/116 |
| 3,536,282 | 10/1970 | Ferris | 410/58 |

FOREIGN PATENT DOCUMENTS

| | | | |
|---|---|---|---|
| 1161695 | 9/1958 | France | 248/354 P |
| 309011 | 3/1969 | Sweden | 248/354 P |

*Primary Examiner*—John E. Murtagh
*Attorney, Agent, or Firm*—Senniger, Powers, Leavitt and Roedel

[57] ABSTRACT

Safety apparatus for a mining machine having a gathering head for gathering product (e.g., coal) in a mine, a conveyor system which extends rearwardly along the machine from the gathering head for conveying the product rearwardly for discharge at the rear of the machine, and power generating equipment for driving the conveyor system and the gathering head. The conveyor system comprises an elongate conveyor support or structure pivotally mounted for swinging movement about a horizontal axis extending transversely of the machine between lowered and raised positions. The machine has a frame having a rear bottom section below the conveyor support and sides extending upwardly from the rear bottom section. Hydraulic lift means is provided between the rear bottom section and the support powered by the power equipment for pivoting the support. Access is provided between the support and the rear bottom section, when the support is raised, for personnel servicing machine components located in this area. A pair of struts is provided each pivotally mounted on the rear bottom section for pivotal movement about an axis extending longitudinally of the machine between a lowered storage position wherein they extend outwardly in the direction toward the sides of the frame and a raised supporting position. With the struts in their supporting position, their upper ends are engageable by the support so that, if hydraulic pressure is lost during maintenance operations, downswing of the support and thus injury to personnel servicing the machine components beneath the support is prevented.

10 Claims, 4 Drawing Figures

SAFETY APPARATUS FOR A MINING MACHINE

BACKGROUND OF THE INVENTION

This invention relates to safety apparatus for a mining machine, and more particularly to safety support means for a conveyor of such a machine.

The invention is particularly concerned with, though not limited to, mining machines of the type known as loaders as well as mining machines of the type known as continuous miners. Such machines generally comprise a gathering head for gathering product (e.g., coal) in a mine, a conveyor system extending rearwardly from the gathering head for conveying the product rearwardly for discharge at the rear of the machine, and power generating equipment for driving the conveyor system and gathering head. The conveyor system of the machine comprises an elongate conveyor support or structure pivotally mounted for swinging movement about a horizontal axis extending transversely of the machine between lowered and raised positions, enabling adjustment of the support to different elevations. The machine further comprises a frame having a rear bottom section beneath the support and sides extending upwardly from said section, and hydraulic lift means between said section and the support actuated by the power equipment for pivoting the support. On occasion, it may be necessary to service the hydraulic lift means or certain machine components located in the area between the rear bottom section and the support, which components are generally accessible to service personnel only from the rear between the rear bottom section and the raised support. A significant risk to service personnel working under the support exists in that if hydraulic pressure to the hydraulic lift means for the support is lost, (as may occur during the servicing operations) the support (which can weigh several tons) may swing down under its weight and crush service personnel on the rear bottom section.

While the lift means of the machine may have counter-balance values for retaining the hydraulic fluid therein to prevent the lift means from retracting and to prevent downswing of the support when pressure is lost, such valves have not proven to be completely reliable. Heretofore, reliance has been placed on service personnel propping up the conveyor support with timbers or the like, but in many instances, this has been ignored because of inconvenience in obtaining props and in utilizing them. Moreover, such propping operations themselves involved a substantial risk to service personnel. To install the props, it was necessary for one person to hold each prop in a supporting position while a second person operating the power equipment lowered the conveyor support into engagement with the upper ends of the props. In addition, in its raised supporting position the props were not highly stable in that only the engagement of the upper ends of the props with the conveyor support and the lower ends of the props with the rear bottom section of the frame held the props in position (i.e., there was no means for securing the props in their supporting positions).

SUMMARY OF THE INVENTION

Among the several objects of this invention may be noted the provision of safety apparatus for a mining machine, and in particular a loader or a continuous miner, comprising safety struts or props which are mounted on the frame of the machine and thus are readily available for use during servicing of the machine; the provision of such struts each of which may be rapidly moved from a lowered storage position to a raised supporting position; the provision of such struts which are adapted to be secured in their supporting position while the conveyor support is being lowered into engagement therewith; the provision of such struts in the use of which a single person can secure the struts in their raised positions and can lower the support into engagement with the upper ends of the struts thereby eliminating the risk associated with communication in a two-man operation; the provision of such struts which have increased load carrying capability; and the provision of such struts which are secured in their supporting position when the conveyor support is in engagement with the upper end of the struts.

As herein illustrated, the safety apparatus of this invention comprises a pair of struts each pivotally mounted on the rear bottom section of the frame of the mining machine for pivotal movement between a lowered storage position and a raised supporting position. The upper end of each strut, when in its supporting position, is engageable by the conveyor support so that, if hydraulic pressure is lost during servicing of the machine components underneath the support machine, downswing of the support and thus injury to personnel servicing the machine components is prevented.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
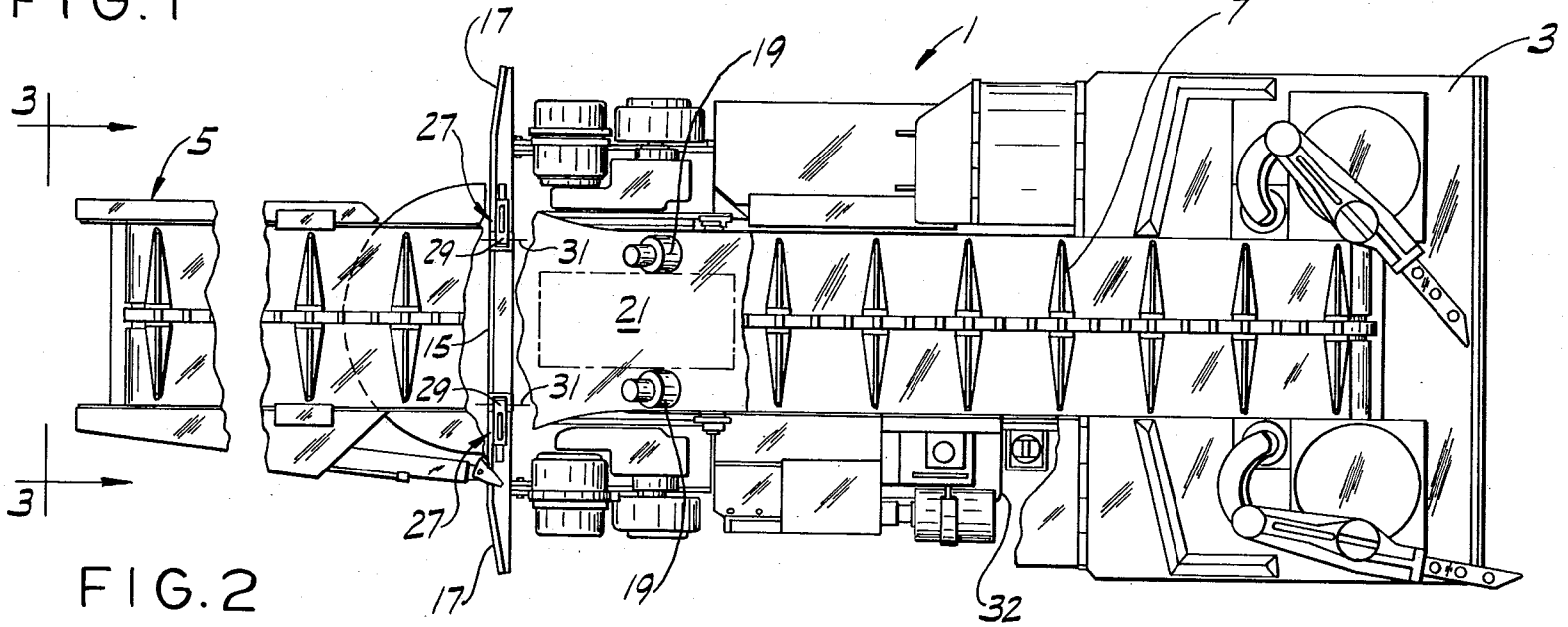
FIG. 1 is a plan of a mining machine, more particularly a loader, with parts broken away.
Figure 2:
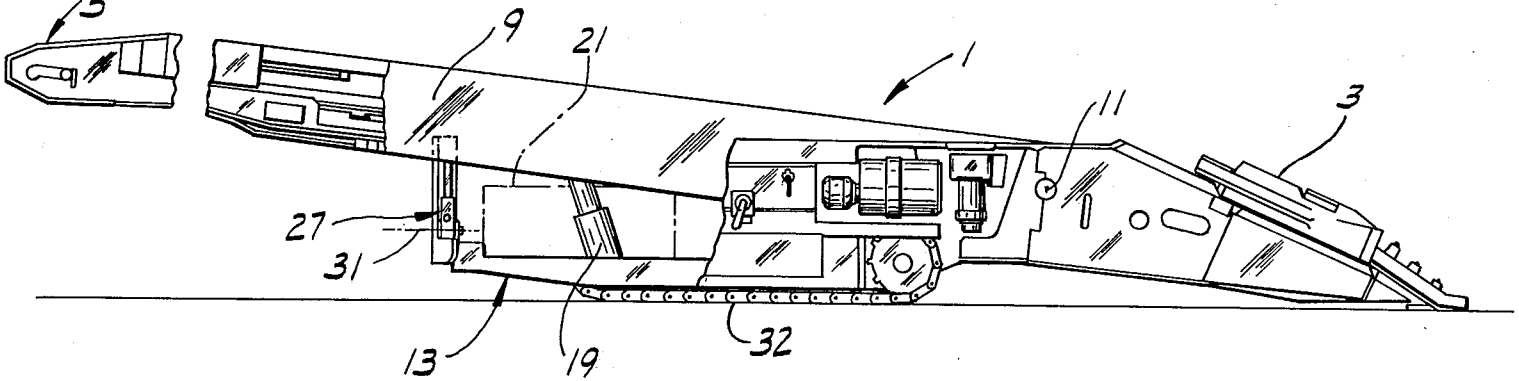
FIG. 2 is a side elevation of the machine with its conveyor support raised and with parts broken away.

The safety apparatus of this invention is herein illustrated as applied to a mining machine of the type referred to as a loader, generally indicated at 1 in FIGS. 1 and 2; it is to be understood that the safety apparatus of this invention also may be used in connection with other mining machines such as continuous miners. In general, this loader is of a conventional type, comprising a gathering head 3 at the forward end of the machine for gathering product (e.g., coal) previously broken away from a seam of the product in a mine. The gathering head moves the product rearwardly of the machine towards discharge means 5 at the rear of the machine 1. The discharge means 5 comprises conveyor means 7 including an elongate conveyor support or structure 9 pivotally mounted for swinging movement between a lowered position and a raised position about a horizontal axis 11 extending transversely of the machine (see FIG. 2). The machine 1 further comprises a frame 13 having a rear bottom section 15 extending rearwardly below the conveyor support 9, side plates 17 extending upwardly from the rear bottom section, and lift means, such as hydraulic rams 19, between the rear bottom section 13 and the support 9 for pivoting the support 9 to different elevations. In addition to the hydraulic rams, conventional loaders also generally have machine components located in the area generally indicated at 21 between the support and the rear bottom section of the frame. Certain of these machine components may be operatively associated with the hydraulic rams. Access is provided between the raised support 9 and the section 15 of the frame 13 for personnel servicing the machine components. To support the support 9 in its down position, the machine has a support plate 23 on the top of the section 15 engageable by bottom 25 of the support 9.

Whenever personnel are servicing the hydraulic rams or the machine components in the area 21 via the access provided between the raised support 9 and the section 15 of the frame 13, there is a possibility that pressure in the hydraulic rams 19 might be lost, thereby allowing the support to swing down and crush the service personnel. The risk of such injury is substantial in that often the required servicing involves release of the hydraulic pressure in the hydraulic lines connected to the rams 19.

Safety apparatus of this invention for supporting the raised support 9 during the servicing of the hydraulic rams or the machine components in the area 21 is shown installed on the machine 1 generally indicated at 27. The safety apparatus comprises a pair of struts or props 29 each pivotally connected to a clevis 30 each secured on the section 15 of the frame 13 toward one side of the frame for pivotal movement about an axis 31 extending in a longitudinal plane of the machine between a lowered storage position (see FIG. 1) and a raised tail supporting position (see FIG. 2).

Figure 3:
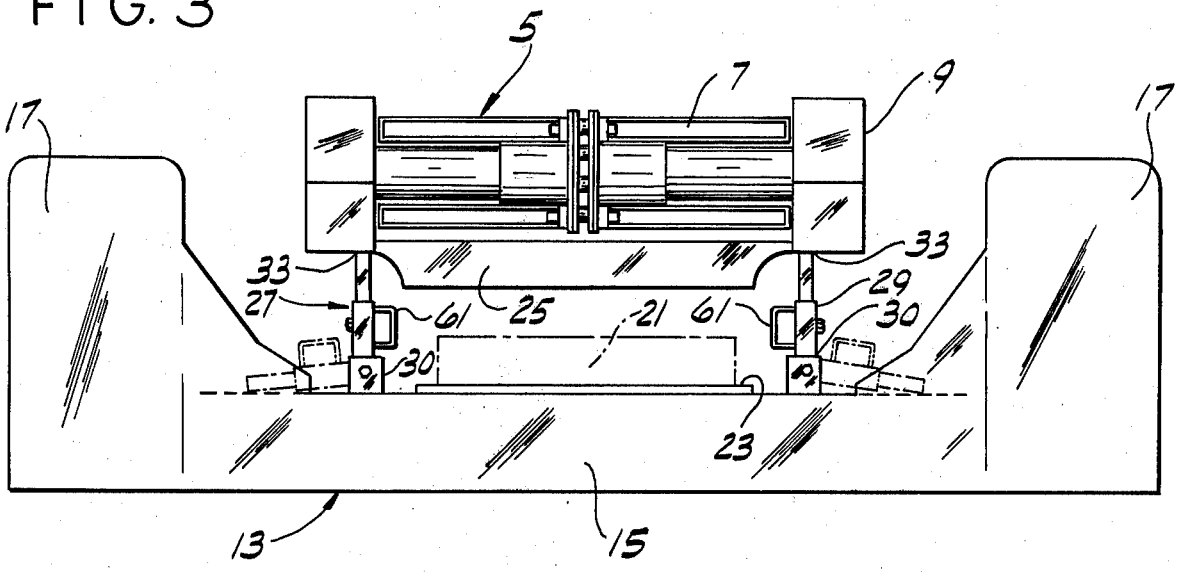
FIG. 3 is a view on line 3—3 of FIG. 1 showing a pair of safety struts disposed between a rear bottom section of the frame of the machine and the conveyor support, and showing the struts in their lowered storage position in phantom.

When in their lowered storage position (see FIGS. 1 and 3), the struts 29 extend outwardly in the direction toward but no farther than the sides of the frame 13 and are positioned above the level of the bottom reach of the caterpillar treads 32 of the machine and spaced inwardly therefrom so that the struts are not directly sprayed with mud from the threads. In addition, the struts, when in their storage position, are located so as not to interfere with the pivoting of the support or be engaged by the bottom 25 of the support 9. When in their raised supporting position, the struts 29 at their upper ends 33 are engageable by the support 9.

Figure 4:
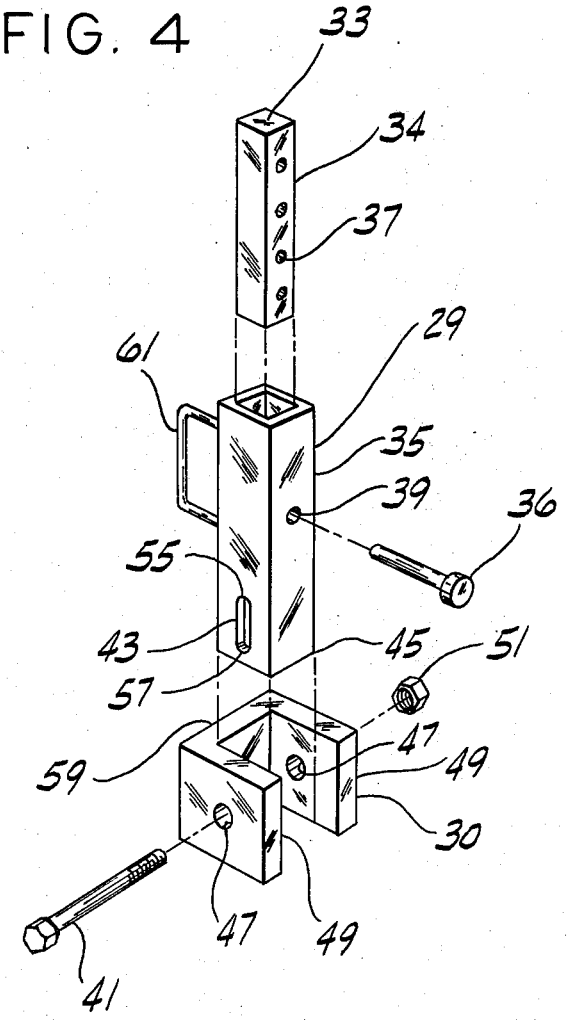
FIG. 4 is an exploded perspective view of one of the safety struts.

In particular, each strut 29 comprises a first elongate member 34 of solid square stock telescoped within a second elongate member 35 of square tubing (see FIG. 4). The first and second members are adjustably secured together by means of a pin 36 adapted to be received in one of a plurality of holes 37 extending transversely through the first member 34 in a central longitudinal plane of the first member and in a hole 39 extending through the second member 35 in a central longitudinal plane of the second member. The second member 35 is pivotally mounted on the clevis 30 by means of a pin 41 adapted to be received in a slot 43 extending transversely through the second member 35 near its lower end 45 in a central longitudinal plane of the second member and in a hole 47 extending transversely through the sides 49 of the clevis 30 in a longitudinal plane of the machine 1. The pin 41 may be releasably secured in the clevis 30 by means of a nut 51 threaded thereon. The slot 43 has an upper end 55 and a lower end 57 and enables the strut 29, when in its raised supporting position, to be lifted from a gravity-biased down locking mode, in which the upper end 55 of the slot engages the pin 41 and the lower end 45 of the second member 35 bears on the rear bottom section 15 of the frame 13, up to an unlocking mode, in which the pin 41 is engaged by the lower end 57 of the slot. Each clevis 30 has an end plate 59 between the legs 49 at the inward side of the second member 35 of the respective strut 29, when in its raised position. The end plate 59 is so located relative to the bolt 41, the ends 55 and 57 of the slot 43 and the inward side of the second member 35 of the strut as to have the end plate 59 engageable by the inward side of the second member 35 to prevent pivoting of the strut when down in its locking mode, and so as to have the inward side of the second member 35 out of engagement with the end plate 59 to enable the outward pivoting of the strut 29, when up in its unlocking mode. A handle 61 is provided on the inward side of the second member 35 (see FIG. 4 of each strut 29) to facilitate the pivoting and lifting of the strut by service personnel.

In use, the struts 29 are moved from their lowered storage position in which they extend out toward the sides of the frame 13 to their raised supporting position (see FIG. 3), when the hydraulic rams or machine components in the area 21 are to be serviced. To do this, the support 9 is pivoted upwardly to a raised position by means of rams 19 and each of the struts 29 is then swung upwardly and inwardly and, at the same time, lifted upwardly away from its respective clevis 30 to the point where the lower end 57 of the slot 43 engages the pin 41 and the inward side of the second member 35 clears the end member 59. Each of the struts 29, in its storage position, extends out toward the respective side of the frame 13 at the rear bottom section of the frame 13, thereby enabling service personnel to reach the struts 29 without having to enter between the raised support 9 and the section 15 of the frame 13. Once in its raised supporting position, each strut 29 is lowered to its locking mode in which the lower end 45 of the second member 35 engages the section 15 of the frame 13 and the inward side of the second member is engageable with the end member 59 to prevent pivoting of the strut. Prior to or, alternatively, after securing the struts 29 in their supporting positions, the telescoped length of the struts 29 may be adjusted. The height to which the support 9 can be raised in the mine limits, in certain instances, the telescoped length of the struts. With the struts 29 adjusted to the desired length, pin 36 is placed in holes 37 and 39 to secure the first member 34 to the second memer 35. The support 9 is then lowered into engagement with the upper ends 33 of the struts 29 so that the weight of the support is transferred via the first member 34, the pin 41 and the second member 35 of each strut 29 to the section 15 of the frame 13. After completing the servicing operation, the struts 29 are moved to their lowered storage position by extending the rams 19 and raising the support 9 out of engagement with the struts 29, lifting each strut until the lower end 57 of the slot 43 engages the pin 41 and pivoting each strut outwardly to its lowered storage position extending out toward the respective side of the frame 13. The struts 29, when in their storage position, may be either of extended length (see FIG. 3) or of retracted length (see FIG. 1).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Safety apparatus for a mining machine having a frame and an elongate structure pivotally mounted for swinging movement on the frame about a horizontal axis extending transversely of the macine, hydraulic lift means between the frame and said pivoted elongated structure for raising and lowering it, access being provided between the frame and said structure when said structure is raised for personnel servicing machine components underneath said structure; said safety apparatus comprising:

a pair of struts each pivotally mounted on the frame for pivotal movement about an axis extending in a longitudinal plane of the machine between a lowered storage position in which the strut extends outwardly toward but no farther than one side of the frame and a raised supporting position, the upper end of each strut, when in supporting position, being engageable by said elongate structure so that, if hydraulic pressure to the lift means is lost during servicing of the machine components underneath said structure, downswing of the elongate structure and thus injury to personnel servicing the machine components is prevented.

2. Apparatus as set forth in claim 1 wherein each strut is pivotally mounted on the frame toward one side of the frame.

3. Apparatus as set forth in claim 1 wherein each strut is pivotally mounted on the frame on a horizontal axis.

4. Apparatus as set forth in claim 1 wherein each strut comprises two elongate members, a first of said members telescoped within the second of said members, and means for releasably securing the members together at any of a plurality of telescoped positions so that the length of the strut can be adjusted.

5. Apparatus as set forth in claim 4 wherein the first member has a series of holes extending transversely therethrough, the second member having a hole extending transversely therethrough, said means for releasably securing the members together comprising a pin adapted to extend through the hole in the second member and one of the holes in the first member.

6. Apparatus as set forth in claim 1 wherein each clevis has a hole extending transversely through two sides of the clevis, the axis of the hole being in a longitudinal plane of the machine, the slot of said pin and slot means extending transversely through the strut, the pin of said pin and slot means extending through the hole in the clevis and the slot in the strut.

7. Apparatus as set forth in claim 6 wherein each clevis has an end plate extending between its said sides adjacent a side of the respective strut when in its raised position, the strut, when in its raised position, being vertically movable upwardly relative to the clevis from a gravity-biased down locking mode to an upward unlocking mode, each strut, when in its locking mode, bearing on the frame and being engageable with the end plate to prevent pivoting of the strut, each strut when in its unlocking mode, being spaced from the end member so that the strut can be pivoted about the pin to said storage position thereof.

8. Apparatus as set forth in claim 4 wherein each strut has handle means to facilitate the rotating and the lifting of the strut.

9. Safety apparatus for a mining machine having a frame and an elongate structure pivotally mounted for swinging movement on the frame about a horizontal axis extending transversely of the machine, hydraulic lift means between the frame and said pivoted elongated structure for raising and lowering it, access being provided between the frame and said structure when said structure is raised for personnel servicing machine components underneath said structure; said safety apparatus comprising:

strut means pivotally mounted on the frame for pivotal movement between a lowered storage position in which the strut means extends laterally outwardly away from a vertical central longitudinal plane of the machine toward but no farther than one side of the frame and a raised supporting position, the upper end of said strut means, when in supporting position, being engageable by said elongate structure so that, if hydraulic pressure to the lift means is lost during servicing of the machine components underneath said structure, downswing of the elongate structure and thus injury to personnel servicing the machine components is prevented.

10. Safety apparatus for a mining machine having a frame and an elongate structure pivotally mounted for swinging movement on the frame about a horizontal axis extending transversely of the machine, hydraulic lift means between the frame and said pivoted elongated structure for raising and lowering it, access being provided between the frame and said structure when said structure is raised for personnel servicing machine components underneath said structure; said safety apparatus comprising:

a pair of struts mounted on the frame for pivotal movement between a lowered position and a raised supporting position, each strut being pivotally secured to a clevis on the frame by pin and slot means, each clevis being secured to the frame at a side thereof and having means for releasably securing the strut in its raised supporting position, the upper end of each strut, when in supporting position, being engageable by said elongate structure so that, if hydraulic pressure to the lift means is lost during servicing of the machine components underneath said structure, downswing of the elongate structure and thus injury to personnel servicing the machine components is prevented.

* * * * *

UNITED STATES PATENT AND TRADEMARK OFFICE

CERTIFICATE OF CORRECTION

PATENT NO. : 4,287,692

DATED : September 8, 1981

INVENTOR(S) : Clifton E. Alexander, Thomas R. Ford and William S. Smith

It is certified that error appears in the above—identified patent and that said Letters Patent is hereby corrected as shown below:

Column 3, line 35, "tail" should be omitted; line 43, "threads" should read -- treads --. Column 5, claim 6, line 49, "claim 1" should read -- claim 10 --.

Signed and Sealed this

*Fifteenth* Day of *December 1981*

[SEAL]

*Attest:*

GERALD J. MOSSINGHOFF

*Attesting Officer*

*Commissioner of Patents and Trademarks*